US009905185B2

(12) United States Patent
Ahn et al.

(10) Patent No.: US 9,905,185 B2
(45) Date of Patent: Feb. 27, 2018

(54) SWITCHED COLUMN DRIVER OF DISPLAY DEVICE

(71) Applicant: MagnaChip Semiconductor, Ltd., Cheongju-si (KR)

(72) Inventors: Chang Ho Ahn, Cheongju-si (KR); Byung Jae Nam, Cheongju-si (KR); Sang Hyun Park, Cheongju-si (KR); Jae Hong Ko, Cheongju-si (KR); Hyun Jin Shin, Cheongju-si (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 15/658,742

(22) Filed: Jul. 25, 2017

(65) Prior Publication Data

US 2017/0323614 A1 Nov. 9, 2017

Related U.S. Application Data

(63) Continuation of application No. 14/197,983, filed on Mar. 5, 2014, now Pat. No. 9,767,749.

(30) Foreign Application Priority Data

Apr. 19, 2013 (KR) ..... 10-2013-0043767

(51) Int. Cl.
*G09G 3/36* (2006.01)

(52) U.S. Cl.
CPC ..... *G09G 3/3677* (2013.01); *G09G 3/3696* (2013.01)

(58) Field of Classification Search
CPC ..... G09G 3/3696; G09G 3/3677
USPC ..... 345/92
See application file for complete search history.

(56) References Cited

U.S. PATENT DOCUMENTS

| | | | |
|---|---|---|---|
| 6,784,865 | B2 | 8/2004 | Akimoto |
| 8,976,097 | B2 | 3/2015 | Lee et al. |
| 2009/0140775 | A1 | 6/2009 | Keane |
| 2009/0219270 | A1 | 9/2009 | Penev et al. |
| 2010/0238146 | A1 | 9/2010 | Zebedee |

(Continued)

FOREIGN PATENT DOCUMENTS

| | | | |
|---|---|---|---|
| EP | 1174852 | A2 | 8/2001 |
| TW | 578134 | B | 3/2004 |

OTHER PUBLICATIONS

Chinese Office Action dated May 2, 2017 in counterpart Chinese patent application No. 20141160557.1 (34 pages with English translation).

*Primary Examiner* — Jonathan Blancha
(74) *Attorney, Agent, or Firm* — NSIP Law

(57) ABSTRACT

A column driver of a display device provides a high slew rate with lowered power requirements by using external switches connected to upper and bottom output buffers. The upper output buffer is driven between a first voltage rail and a second voltage rail, and outputs a first output signal in response to a first input signal and a second input signal. The bottom output buffer is driven between the second voltage rail and a third voltage rail, and outputs a second output signal in response to a third input signal and a fourth input signal. A first switch group selectively provides input for the upper output buffer and the bottom output buffer. A second switch group feeds back the first and the second output signals to the first or the second input terminal of each of the upper output buffer and the bottom output buffer.

16 Claims, 4 Drawing Sheets

(56) References Cited

U.S. PATENT DOCUMENTS

| | | | |
|---|---|---|---|
| 2011/0261086 | A1 | 10/2011 | Tu |
| 2012/0062311 | A1 | 3/2012 | Chen et al. |
| 2012/0081338 | A1 | 4/2012 | Kim et al. |
| 2013/0100004 | A1 | 4/2013 | Lee et al. |

SWITCHED COLUMN DRIVER OF DISPLAY DEVICE

CROSS-REFERENCE TO RELATED APPLICATIONS

This application is a continuation of application Ser. No. 14/197,983 filed on Mar. 5, 2014, which claims the benefit under 35 U.S.C. § 119(a) of Korean Patent Application No. 10-2013-0043767 filed on Apr. 19, 2013, in the Korean Intellectual Property Office, the entire disclosure of which is incorporated herein by reference for all purposes.

BACKGROUND

1. Field

The following description relates to a column driver of a display device, and to a column driver of a display device configured to improve external switch construction that is connected with upper and bottom output buffers and that feature a high slew rate and low power.

2. Description of Related Art

Generally, for an integrated circuit to drive a panel of a display device, a slew rate of the integrated circuit is arising as an important factor in its operation, due to an increase of load capacitance and a reduction of horizontal period, according to the increase. In electronics, a slew rate is defined as the maximum rate of change of output voltage per unit of time. Such an integrated circuit may be referred to as a Display Driver IC (DDI) or display driver device.

Also, from the viewpoint of mounting environment of a panel DDI, conventionally, a Source Integrated Circuit (IC) was configured to drive one liquid crystal. More recently, a Source IC may drives three liquid crystals, which requires that an IC drives two more liquid crystals. Due to these increased demands that are placed on the DDI, realization of a fast slewing time becomes necessary.

Also, a display driver device may be designed to feature a reduction of current consumption, a high slew rate, a fast slewing time or a fast settling time, since realization of fast slewing time and low power consumed therein are also design goals of a display driver device.

FIG. 1 illustrates a plan view indicating a Liquid Crystal Display device.

A Liquid Crystal Display device (LCD) offers advantages such as miniaturization, thinness and low power consumption. For example, LCD technology is used for an LCD screen panel of a notebook computer and an LCD TV. Specifically, an example LCD device whose type is active matrix uses a Thin Film Transistor (TFT) as a switch element and is a display technology that is suitable for displaying a moving image.

When referring to FIG. 1, a Liquid Crystal Display device (LCD) 1 comprises a liquid crystal panel 2, source drivers (SD) having many source lines (SL) respectively, and gate drivers (GD) having many gate lines (GL) respectively. A source line (SL) may also be referred to a data line or a data channel.

Each of the source drivers (SD) drives source lines (SL) arranged on the liquid crystal panel 2. Each of the gate drivers (GD) drives gate lines (GL) arranged on a liquid crystal panel 2.

The liquid crystal panel 2 comprises many pixels 3. Each of the pixels 3 comprises a switch transistor (TR), a storage capacitor (CST) for reducing a current leakage from the liquid crystal, and a liquid crystal capacitor (CLC). A switch transistor (TR) is turned on and turned off in response to a signal driving a gate line (GL). A terminal of the switch transistor (TR) that is turned on and turned off by the signal from gate line (GL) is connected to a source line (SL).

A storage capacitor (CST) is connected between another terminal of the switch transistor (TR) and a grounding voltage (VSS), and the liquid crystal capacitor (CLC) is connected between another terminal of the switch transistor (TR) and a common voltage (VCOM). In an example, the common voltage (VCOM) is a power voltage, such as VDD/2.

The load of each of the source lines (SL) connected to the pixels 3 arranged on the liquid crystal panel 2 may be modeled by representing it using parasitic resistors and parasitic capacitors.

FIG. 2 illustrates a schematic view indicating a source driver used in FIG. 1, as discussed above.

When referring to FIG. 2, a source driver 50 includes an output buffer 10, an output switch 11, an output protection resistor 12 and a load 13 connected to a source line. The output buffer 10 delivers an analog moving image signal to a corresponding output switch 11 for amplification. The output switch 11 outputs the amplified analog moving image signal as a signal that drives a source line, in response to an activation of a signal controlling an output switch 11, such as switch (OSW) and/or switch (OSWB). The signal driving source line is provided with the load 13 connected to the source line. As illustrated in FIG. 2, the load 13 is modeled as parasitic resistors (RL1 to RL5) and as parasitic capacitors (CL1 to CL5) such that the parasitic resistors (RL1 to RL5) and as parasitic capacitors (CL1 to CL5) are connected in a ladder type structure.

However, according to this example approach, the output switch 11 has a plurality of transmission switches. Therefore, a slew rate becomes low, due to a resistance element resulting from the use of the plurality of transmission switches. Thus, the slewing time increases, which potentially interferes with the functionality of the device. Also, another issue that occurs is that elevating the slew rate potentially increases current consumption, which may also be detrimental to the functionality of the device.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure has as an objective to provide a column driver of a display device configured to feature a high slew rate and low power by providing an improved external switch construction connected with upper and bottom output buffers.

In one general aspect, a column driver of a display device includes an upper output buffer configured to be driven between a first voltage rail and a second voltage rail, and output a first output signal in response to a first input signal and a second input signal, a bottom output buffer configured to be driven between the second voltage rail and a third voltage rail, and output a second output signal in response to a third input signal and a fourth input signal, a first switch group configured to selectively provide the first to the fourth input signals for a first or a second input terminal of each of the upper output buffer and the bottom output buffer, and a second switch group configured to feed back the first and the second output signals to the first or the second input terminal of each of the upper output buffer and the bottom output buffer.

The upper output buffer may be connected to a high power voltage from the first voltage rail and connected to a half power voltage from the second voltage rail, and the bottom output buffer may be connected to a half power voltage from the second voltage rail and connected to a low power voltage from the third voltage rail.

The half power voltage may be a half level voltage intermediate between the high power voltage of the first voltage rail and the low power voltage of the third voltage rail.

The first switch group may include an eleventh switch configured to provide the first input signal for a first input terminal of the upper output buffer, a twelfth switch configured to provide the second input signal for a second input terminal of the upper output buffer, a thirteenth switch configured to provide the third input signal for a first input terminal of the bottom output buffer, and a fourteenth switch configured to provide the fourth input signal for a second input terminal of the bottom output buffer.

The second switch group may include a twenty-first switch configured to feed back the first output signal to the first input terminal of the upper output buffer, a twenty-second switch configured to feed back the first output signal to the second input terminal of the upper output buffer, a twenty-third switch configured to feed back the second output signal to the first input terminal of the bottom output buffer, and a twenty-fourth switch configured to feed back the second output signal to the second input terminal of the bottom output buffer.

In response to the eleventh to the fourteenth switches being provided with the high power voltage of the first voltage rail, the twenty-first to the twenty-fourth switches may be provided with the high power voltage of the first voltage rail, or the twenty-first and the twenty-second switches may be provided with the high power voltage of the first voltage rail and the twenty-third and the twenty-fourth switches may be provided with the half power voltage of the second voltage rail, or the twenty-first to the twenty-fourth switches may be provided with the half power voltage of the second voltage rail.

In response to the eleventh and the twelfth switches being provided with the high power voltage of the first voltage rail and the thirteenth and the fourteenth switches being provided with the half power voltage of the second voltage rail, the twenty-first to the twenty-fourth switches may be provided with the high power voltage of the first voltage rail, or the twenty-first and the twenty-second switches may be provided with the high power voltage of the first voltage rail and the twenty-third and the twenty-fourth switches are provided with the half power voltage of the second voltage rail, or the twenty-first to the twenty-fourth switches may be provided with the half power voltage of the second voltage rail.

In response to the eleventh to the fourteenth switches being provided with the half power voltage of the second voltage rail, the twenty-first to the twenty-fourth switches may be provided with the high power voltage of the first voltage rail, or the twenty-first and the twenty-second switches may be provided with the high power voltage of the first voltage rail and the twenty-third and the twenty-fourth switches may be provided with the half power voltage of the second voltage rail, or the twenty-first to the twenty-fourth switches may be provided with the half power voltage of the second voltage rail.

The column driver of the display device may further include a third switch group configured to provide the first or the second output signal to a first or a second panel selectively.

The third switch group may include a thirty-first switch configured to provide the first output signal for the first panel, a thirty-third switch configured to provide the first output signal for the second panel, a thirty-second switch configured to provide the second output signal for the first panel, and a thirty-fourth switch configured to provide the second output signal for the second panel.

The column driver of the display device may further include a fortieth switch configured to make the signals provided to the first panel and the second panel separate.

The column driver of the display device may further include a first regulator and a second regulator configured to generate the high power voltage, the half power voltage and the low power voltage, and provide the voltages for the first to the third voltage rails selectively.

The first regulator and the second regulator may be connected with an external printed circuit board (PCB) or integrated circuit (IC) and each other in a row.

The column driver of the display device may further include a positive decoder configured to provide voltages to each of switches in the first switch group, and a negative decoder configured to provide voltages to each of the switches in the first switch group.

The voltages provided by the positive and negative decoders may be voltages from at the first voltage rail or the second voltage rail.

The positive decoder may be further configured to provide a voltage to each of the switches in the second switch group, and the negative decoder may be further configured to provide a voltage to each of the switches in the second switch group.

The voltages provided by the positive and negative decoders are voltages from the first voltage rail or the second voltage rail.

In another general aspect, a display apparatus includes first and second panels, and a column driver, including an upper output buffer configured to be driven between a first voltage rail and a second voltage rail, and output a first output signal in response to a first input signal and a second input signal, a bottom output buffer configured to be driven between the second voltage rail and a third voltage rail, and output a second output signal in response to a third input signal and a fourth input signal, a first switch group selectively providing the first to the fourth input signals for a first or a second input terminal of each of the upper output buffer and the bottom output buffer, and a second switch group which feeds back the first and the second output signals to the first or the second input terminal of each of the upper output buffer and the bottom output buffer, wherein the first output signal and second output signals are provided to the first and second panels for display, selectively.

The display apparatus may further include a third switch group providing the first or the second output signal to a first or a second panel selectively.

The panels may be LCD panels.

According to the column driver of display device of the present disclosure configured as above, effects are provided, in which a current consumption can be reduced by improving the external switch construction connected to the upper and bottom output buffers and features of a high-slew-rate and low power can be enhanced.

Other features and aspects will be apparent from the following detailed description, the drawings, and the claims.

Figure 1:
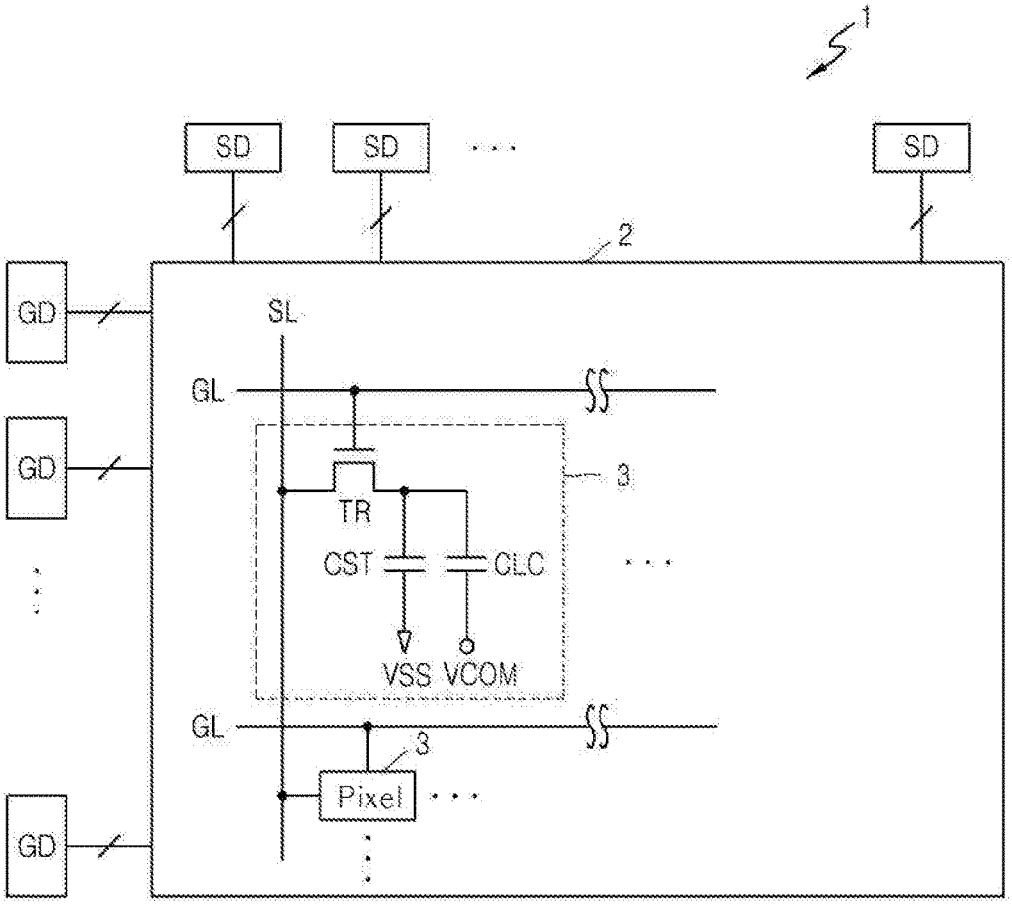
FIG. 1 illustrates a plan view indicating a Liquid Crystal Display (LCD) device.
Figure 2:
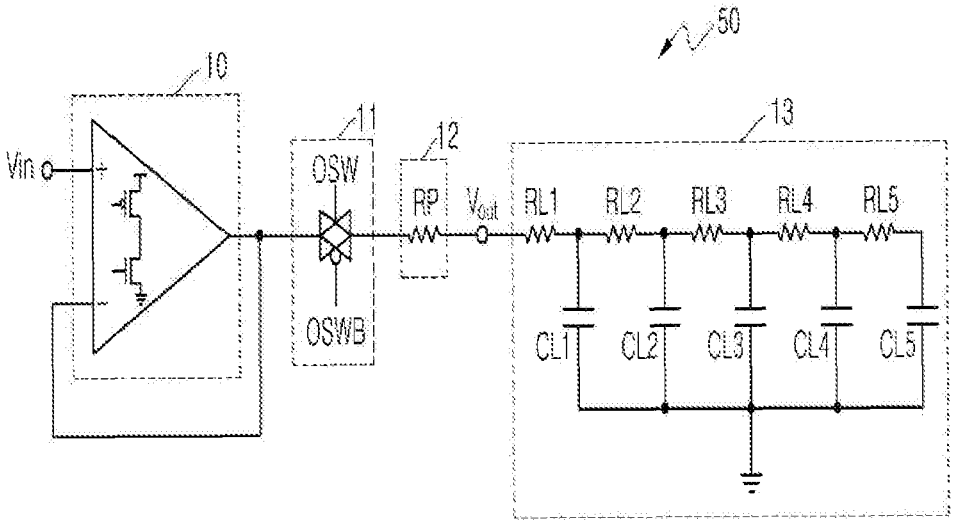
FIG. 2 illustrates a schematic view indicating a source driver used in the device of FIG. 1.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Figure 3:
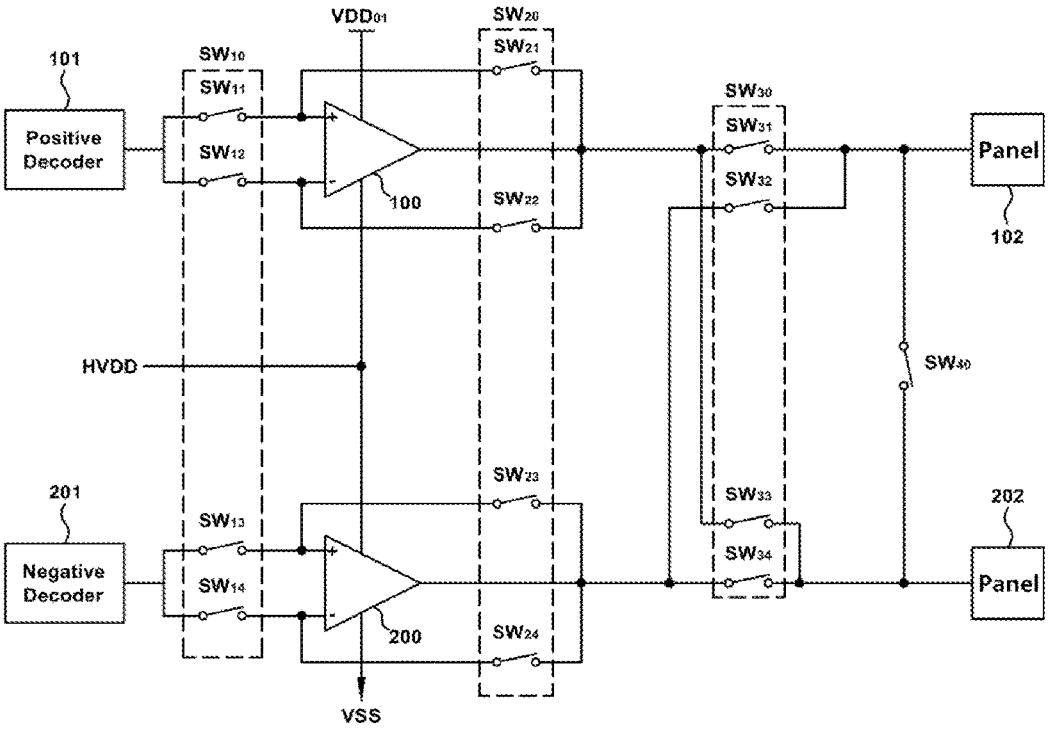
FIG. 3 illustrates a plan view indicating a switch construction for a column driver of a display device and for an offset cancellation according to an embodiment.

FIG. 3 illustrates a plan view indicating a switch construction for a column driver of a display device and an offset cancellation according to an embodiment.

As illustrated in FIG. 3, the column driver of the display device according to an exemplary embodiment of the present disclosure includes several elements. The column driver includes an upper output buffer 100 and a bottom output buffer 200.

The upper output buffer 100 is configured to be driven between a first voltage rail (VDD) and a second voltage rail (HVDD). The upper output buffer 100 outputs a first output signal in response to a first input signal and a second input signal. The bottom output buffer 200 is configured to be driven between the second voltage rail (HVDD) and the third voltage rail (VSS), and the bottom output buffer 200 outputs a second output signal in response to a third input signal and a fourth input signal.

The column driver additionally includes a first switch group ($SW_{10}$) and a second switch group ($SW_{20}$).

The first switch group ($SW_{10}$) is configured to selectively provide the first to fourth input signals for a first or a second input terminal of each of the upper output buffer 100 and the bottom output buffer 200.

The second switch group ($SW_{20}$) is configured to feed back the first and the second output signals to the first or the second input terminal of each of the upper output buffer 100 and the bottom output buffer 200.

The upper output buffer 100 is connected to a high power voltage from the first voltage rail (VDD) and connected to a half power voltage from the second voltage rail (HVDD). The bottom output buffer 200 is connected to a half power voltage from the second voltage rail (HVDD) and connected to a low power voltage from the third voltage rail (VSS).

The half power voltage is a half level voltage between the high power voltage of the first voltage rail (VDD) and the low power voltage of the third voltage rail (VSS).

The first switch group ($SW_{10}$) includes several switches. For example, the first switch group ($SW_{10}$) includes an eleventh switch ($SW_{11}$) providing the first input signal for a first input terminal of the upper output buffer 100, a twelfth switch ($SW_{12}$) providing the second input signal for a second input terminal of the upper output buffer 100, a thirteenth switch ($SW_{13}$) providing the third input signal for a first input terminal of the bottom output buffer 200, and a fourteenth switch ($SW_{14}$) providing the fourth input signal for a second input terminal of the bottom output buffer 200.

The second switch group ($SW_{20}$) also includes several switches. For example, the second switch group ($SW_{20}$) includes a twenty-first switch ($SW_{21}$) which feeds back the first output signal to the first input terminal of the upper output buffer 100, a twenty-second switch ($SW_{22}$) which feeds back the first output signal to the second input terminal of the upper output buffer 100, a twenty-third switch ($SW_{23}$) which feeds back the second output signal to the first input terminal of the bottom output buffer 200, and a twenty-fourth switch ($SW_{24}$) which feeds back the second output signal to the second input terminal of the bottom output buffer 200.

When the eleventh switch ($SW_{11}$), twelfth switch ($SW_{12}$), thirteenth switch ($SW_{13}$), and fourteenth switch ($SW_{14}$) are provided with the high power voltage of the first voltage rail, three scenarios are possible.

In one scenario, the twenty-first, twenty-second, twenty-third, and twenty-fourth switches ($SW_{21}$, $SW_{22}$, $SW_{23}$, $SW_{24}$) are provided with the high power voltage of the first voltage rail (VDD).

In a second scenario the twenty-first and the twenty-second switches ($SW_{21}$, $SW_{22}$) are provided with the high power voltage of the first voltage rail (VDDD) and the twenty-third and the twenty-fourth switches ($SW_{23}$, $SW_{24}$) are provided with the half power voltage of the second voltage rail (HVDD).

In a third scenario, all of the twenty-first, twenty-second, twenty-third, and twenty-fourth switches ($SW_{21}$, $SW_{22}$, $SW_{23}$, $SW_{24}$) are provided with the half power voltage of the second voltage rail (HVDD).

When the eleventh switch ($SW_{11}$) and the twelfth switch ($SW_{12}$) are provided with the high power voltage of the first voltage rail (VDD) and the thirteenth switch ($SW_{13}$) and the fourteenth switch ($SW_{14}$) are provided with the half power voltage of the second voltage rail (HVDD), the twenty-first, twenty-second, twenty-third, and twenty-fourth switches ($SW_{21}$, $SW_{22}$, $SW_{23}$, $SW_{24}$) are provided with the high power voltage of the first voltage rail (VDD), or the twenty-first and the twenty-second switches ($SW_{21}$, $SW_{22}$) are provided with the high power voltage of the first voltage rail (VDD) and the twenty-third and the twenty-fourth switches ($SW_{23}$, $SW_{24}$) are provided with the half power voltage of the second voltage rail (HVDD), or the twenty-first, twenty-second, twenty-third, and twenty-fourth switches ($SW_{21}$, $SW_{22}$, $SW_{23}$, $SW_{24}$) are provided with the half power voltage of the second voltage rail (VSS).

When the eleventh switch ($SW_{11}$), twelfth switch ($SW_{12}$), thirteenth switch ($SW_{13}$), and fourteenth switch ($SW_{14}$) are provided with the half power voltage of the second voltage rail (HVDD), the twenty-first, twenty-second, twenty-third, and twenty-fourth switches ($SW_{21}$, $SW_{22}$, $SW_{23}$, $SW_{24}$) are provided with the high power voltage of the first voltage rail (VDD), or the twenty-first and the twenty-second switches ($SW_{21}$, $SW_{22}$) are provided with the high power voltage of the first voltage rail (VDD) and the twenty-third and the twenty-fourth switches ($SW_{23}$, $SW_{24}$) are provided with the half power voltage of the second voltage rail (HVDD), or the twenty-first, twenty-second, twenty-third, and twenty-fourth switches ($SW_{21}$, $SW_{22}$, $SW_{23}$, $SW_{24}$) are provided with the half power voltage of the second voltage rail HVDD.

The column driver of the display device may further include a third switch group ($SW_{30}$) providing the first or the second output signal for the first panel 102 or second panel 202 selectively.

For example, the third switch group ($SW_{30}$) includes a thirty-first switch ($SW_{31}$) providing the first output signal for the first panel 102, a thirty-third switch ($SW_{33}$) providing the first output signal for the second panel 202, a thirty-second switch ($SW_{32}$) providing the second output signal for the first panel, and a thirty-fourth switch ($SW_{34}$) providing the second output signal for the second panel.

The column driver of the display device may further comprise a fortieth switch ($SW_{40}$) making the first panel 102 and the second panel 202 separate.

Figure 4:
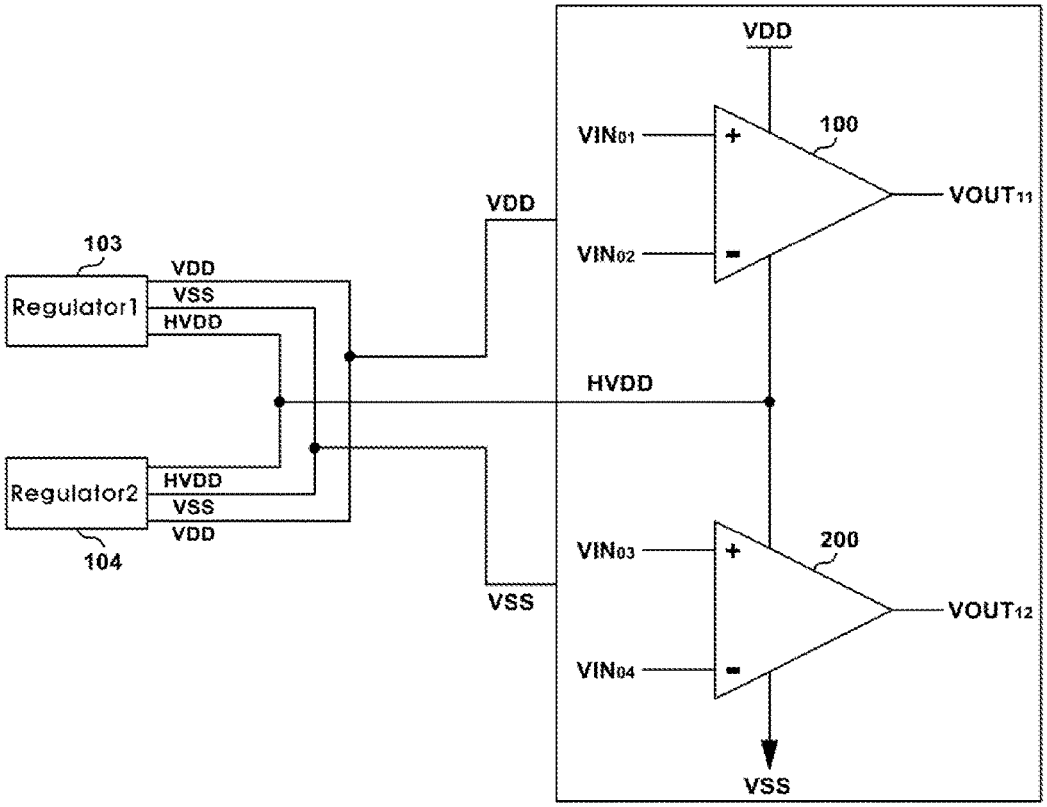
FIG. 4 illustrates a plan view indicating a power supply construction according to the embodiment illustrated in FIG. 3.

FIG. 4 illustrates a plan view indicating a power supply construction according to the embodiment illustrated in FIG. 3.

As shown in the example of FIG. 4, the column driver of the display device may further comprise a first regulator 103 and a second regulator 104 configured to be connected with an external PCB or IC each other in a row, and generate the high power voltage, the half power voltage and the low power voltage, and thus provide the voltages for the first voltage rail (VDD), the second voltage rail (HVDD) and the third voltage rail (VSS) selectively.

The upper output buffer 100 has the first input signal ($VIN_{01}$), the second input signal ($VIN_{02}$) and the first output signal ($VOUT_{01}$). The bottom output buffer 200 has the third input signal ($VIN_{03}$), the fourth input signal ($VIN_{04}$) and the second output signal ($VOUT_{02}$).

The upper output buffer 100 and the bottom output buffer 200 are provided with the input high voltage, half voltage or low voltage from any one of the first voltage rail (VDD), the second voltage rail (HVDD), and the third voltage rail (VSS).

In this example, the upper output buffer 100 is driven between the first voltage rail (VDD) and the second voltage rail (HVDD) and it outputs the first output signal as a first output signal ($VOUT_{01}$) in response to the first input signal ($VIN_{01}$) and the second input signal ($VIN_{02}$).

Further, the bottom output buffer 200 is driven between the second voltage rail (HVDD) and the third voltage rail (VSS) and it outputs the second output signal as a second output signal ($VOUT_{02}$) in response to the third input signal ($VIN_{03}$) and the fourth input signal ($VIN_{04}$).

In an example, a voltage value of the second voltage rail (HVDD) is a half voltage value between the first voltage rail (VDD) and the third voltage rail (VSS).

As a detailed example, when the first voltage rail (VDD) is +10V and the third voltage rail (VSS) is 0V, the second voltage rail (HVDD) is +5V; when the first voltage rail (VDD) is +10V and the third voltage rail (VSS) is −10V, the second voltage rail (HVDD) is 0V.

As illustrated in FIG. 3, circuits for supplying a voltage and for feedback may be configured by connecting an eleventh, twelfth, thirteenth and fourteenth switch ($SW_{11}$, $SW_{12}$, $SW_{13}$, $SW_{14}$) and a twenty-first, twenty-second, twenty-third, and twenty-fourth switch ($SW_{21}$, $SW_{22}$, $SW_{23}$, $SW_{24}$) at the upper output buffer 100 and the bottom output buffer 200.

The upper output buffer 100 is driven between the first voltage rail (VDD) and the second voltage rail (HVDD) and it outputs the first output signal as a first output signal ($VOUT_{01}$) in response to the first input signal ($VIN_{01}$) and the second input signal ($VIN_{02}$).

Thus, the eleventh switch ($SW_{11}$) provides the first input signal ($VIN_{01}$) for a first input terminal (+) of the upper output buffer 100 and the twelfth switch ($SW_{12}$) provides the second input signal ($VIN_{02}$) for a second input terminal (−) of the upper output buffer 100.

The bottom output buffer 200 is driven between the second voltage rail (HVDD) and the third voltage rail (VSS) and it outputs the second output signal as a second output signal ($VOUT_{02}$) in response to the third input signal ($VIN_{03}$) and the fourth input signal ($VIN_{04}$).

Thus, the thirteenth switch ($SW_{13}$) provides the third input signal ($VIN_{03}$) for the first input terminal (+) of the bottom output buffer 200 and the fourteenth switch ($SW_{14}$) provides the fourth input signal ($VIN_{04}$) for the second input terminal (−) of the bottom output buffer 200.

Also, the twenty-first switch ($SW_{21}$) feeds back the first output signal ($VOUT_{01}$) to the first input terminal (+) of the upper output buffer 100 and the twenty-second switch ($SW_{22}$) feeds back the first output signal ($VOUT_{01}$) to the second input terminal (−) of the upper output buffer 100.

The twenty-third switch ($SW_{23}$) feeds back the second output signal ($VOUT_{02}$) to the first input terminal (+) of the bottom output buffer 200 and the twenty-fourth switch ($SW_{24}$) feeds back the second output signal ($VOUT_{02}$) to the second input terminal (−) of the bottom output buffer 200.

The third switch group ($SW_{30}$) includes a thirty-first switch ($SW_{31}$) providing the first output signal ($VOUT_{01}$) for the first panel 102, a thirty-third switch ($SW_{33}$) providing the first output signal ($VOUT_{01}$) for the second panel 202, a thirty-second switch ($SW_{32}$) providing the second output signal ($VOUT_{02}$) for the first panel 102, a thirty-fourth switch ($SW_{34}$) providing the second output signal ($VOUT_{02}$) for the second panel 202, and a fortieth switch ($SW_{40}$) separating the first panel 102 and the second panel 202.

In examples, each of the switches is provided with the first voltage rail (VDD) and the second voltage rail (HVDD) selectively. For example, suppliable combinations of input voltage according to the exemplary embodiments of the present disclosure are indicated below as Table 1.

TABLE 1

| | Item | | | | | | | | | | | |
|---|---|---|---|---|---|---|---|---|---|---|---|---|
| | First Switch Group SW10 | | | | Second Switch Group SW20 | | | | Third Switch Group SW30 | | | |
| | Decoder | | | | | | | | | | | |
| | Positive Decoder | | Negative Decoder | | Positive Decoder | | Negative Decoder | | Positive Decoder | | Negative Decoder | |
| | Switch | | | | | | | | | | | |
| | $SW_{11}$ | $SW_{12}$ | $SW_{13}$ | $SW_{14}$ | $SW_{21}$ | $SW_{22}$ | $SW_{23}$ | $SW_{24}$ | $SW_{31}$ | $SW_{32}$ | $SW_{33}$ | $SW_{34}$ |
| Embodiment 11 | HV | HV | HV | HV | HV | HV | HV | HV | HV | HV | HV | HV |
| Embodiment 12 | | | | | HV | HV | MV | MV | | | | |
| Embodiment 13 | | | | | MV | MV | MV | MV | | | | |
| Embodiment 21 | HV | HV | MV | MV | HV | HV | HV | HV | | | | |
| Embodiment 22 | | | | | HV | HV | MV | MV | | | | |
| Embodiment 23 | | | | | MV | MV | MV | MV | | | | |
| Embodiment 31 | MV | MV | MV | MV | HV | HV | HV | HV | | | | |
| Embodiment 32 | | | | | HV | HV | MV | MV | | | | |
| Embodiment 33 | | | | | MV | MV | MV | MV | | | | |

In Table 1, HV denotes a supply voltage of a first voltage rail (VDD) and MV denotes a supply voltage of a second voltage rail (HVDD).

Thus in an example, some of the switches ($SW_{11}$, $SW_{12}$, $SW_{21}$, $SW_{22}$, $SW_{31}$, $SW_{32}$) are provided selectively with supply voltages of the first voltage rail (VDD) and the second voltage rail (HVDD) from a positive decoder 101. Other switches ($SW_{13}$, $SW_{14}$, $SW_{23}$, $SW_{24}$, $SW_{33}$, $SW_{34}$) are provided selectively with supply voltages of the first voltage rail (VDD) and the second voltage rail (HVDD) from a negative decoder 201.

Therefore, as illustrated in the embodiment 11 of Table 1, a twenty-first to a twenty-fourth switches ($SW_{21}$, $SW_{22}$, $SW_{23}$, $SW_{24}$) may be provided with HV in a lump, under the condition that an eleventh to a fourteenth switches ($SW_{11}$, $SW_{12}$, $SW_{13}$, $SW_{14}$) are provided with HV.

Meanwhile, as illustrated in the embodiment 12 of Table 1, a twenty-first and a twenty-second switch ($SW_{21}$, $SW_{22}$) are provided with HV from a positive decoder 101 and a twenty-third and a twenty-fourth switch ($SW_{23}$, $SW_{24}$) may be provided with MV selectively from a negative decoder 201, under the condition that an eleventh to a fourteenth switch ($SW_{11}$, $SW_{12}$, $SW_{13}$, $SW_{14}$) are provided with HV as described above.

In another example, as illustrated in the embodiment 13 of Table 1, a twenty-first to a twenty-fourth switch ($SW_{21}$, $SW_{22}$, $SW_{23}$, $SW_{24}$) is provided with MV in a lump, under the condition that an eleventh to a fourteenth switch ($SW_{11}$, $SW_{12}$, $SW_{13}$, $SW_{14}$) are provided with HV.

Thus, in these examples, the thirty-first to the thirty-fourth switch ($SW_{31}$, $SW_{32}$, $SW_{33}$, $SW_{34}$) is provided with HV at all times.

Further, as illustrated in the embodiment 21 of Table 1, a twenty-first to a twenty-fourth switch ($SW_{21}$, $SW_{22}$, $SW_{23}$, $SW_{24}$) are provided with HV in a lump, under the condition that an eleventh and a twelfth switch ($SW_{11}$, $SW_{12}$) are provided with HV from a positive decoder 101 and a thirteenth and a fourteenth switch ($SW_{13}$, $SW_{14}$) are provided with MV selectively from a negative decoder 201.

Meanwhile, as illustrated in the embodiment 22 of Table 1, a twenty-first and a twenty-second switch ($SW_{21}$, $SW_{22}$) are provided with HV from a positive decoder 101, and a twenty-third and a twenty-fourth switch ($SW_{23}$, $SW_{24}$) are provided with MV selectively from a negative decoder 201, under the condition that an eleventh and a twelfth switch ($SW_{11}$, $SW_{12}$) are provided with HV from a positive decoder 101 and a thirteenth and a fourteenth switch ($SW_{13}$, $SW_{14}$) are provided with MV selectively from a negative decoder 201.

In another example, as illustrated in the embodiment 23 of Table 1, a twenty-first to a twenty-fourth switch ($SW_{21}$, $SW_{22}$, $SW_{23}$, $SW_{24}$) may be provided with MV in a lump, under the condition that an eleventh and a twelfth switch ($SW_{11}$, $SW_{12}$) are provided with HV from a positive decoder 101 and a thirteenth and a fourteenth switch ($SW_{13}$, $SW_{14}$) are provided with MV selectively from a negative decoder 201.

Also, in this example, the thirty-first to the thirty-fourth switch ($SW_{31}$, $SW_{32}$, $SW_{33}$, $SW_{34}$) is provided with HV at all times.

Further, as illustrated in the embodiment 31 of Table 1, a twenty-first to a twenty-fourth switch ($SW_{21}$, $SW_{22}$, $SW_{23}$, $SW_{24}$) are provided with HV in a lump, under the condition that an eleventh to a fourteenth switch ($SW_{11}$, $SW_{12}$, $SW_{13}$, $SW_{14}$) are provided with MV.

Meanwhile, as illustrated in the embodiment 12 of the Table 1, a twenty-first and a twenty-second switch ($SW_{21}$, $SW_{22}$) are provided with HV from a positive decoder 101 and a twenty-third and a twenty-fourth switch ($SW_{23}$, $SW_{24}$) are provided with MV selectively from a negative decoder 201, under the condition that an eleventh to a fourteenth switch ($SW_{11}$, $SW_{12}$, $SW_{13}$, $SW_{14}$) are provided with MV as described above.

In another example, as illustrated in the embodiment 13 of Table 1, a twenty-first to a twenty-fourth switch ($SW_{21}$, $SW_{22}$, $SW_{23}$, $SW_{24}$) are provided with MV in a lump, under the condition that an eleventh to a fourteenth switch ($SW_{11}$, $SW_{12}$, $SW_{13}$, $SW_{14}$) are provided with MV.

Also, in this example, the thirty-first to the thirty-fourth switch ($SW_{31}$, $SW_{32}$, $SW_{33}$, $SW_{34}$) are provided with HV at all times.

Further, each of the switches of the first to the third switch groups ($SW_{10}$, $SW_{20}$, $SW_{30}$) may be configured as a combination of transmission gates of transistors or as a combination of single transistors.

Therefore, the present application includes a technology that is configured not to upsize a layout area of a display driver device, and to feature a high slew rate without increasing a current consumption. This goal is accomplished by using an output buffer and a switch whose construction is improved. For example, various embodiments allow selection of an input voltage of each of the switches and additional selections and related operations and actions to achieve the above benefits.

FIG. 4 illustrates a plan view indicating a power supply construction according to an embodiment in FIG. 3.

As illustrated, the power supply construction of the column driver of the display device according to the present disclosure provides the first voltage rail ($V_{01}$), the second voltage rail ($V_{02}$) and the third voltage rail ($V_{03}$) selectively from the first regulator 103 and the second regulator 104 formed on the external printed circuit board (PCB) (not illustrated) or integrated circuit (IC).

That is, the first regulator 103 and the second regulator 104 are connected by the external PCB or IC with each other in a row and they generate the high power voltage, the half power voltage and the low power voltage and provide the said voltages for the first to the third voltage rails selectively as discussed above.

Therefore, the upper output buffer 100 and the bottom output buffer 200 are provided with the input high, half, or low voltages from any one of the first voltage rail (VDD), the second voltage rail (HVDD) and the third voltage rail (VSS).

The image display apparatus may be implemented as a liquid crystal display (LCD), a light-emitting diode (LED) display, a plasma display panel (PDP), a screen, a terminal, and the like. A screen may be a physical structure that includes one or more hardware components that provide the ability to render a user interface and/or receive user input. The screen can encompass any combination of display region, gesture capture region, a touch sensitive display, and/or a configurable area. The screen can be embedded in the hardware or may be an external peripheral device that may be attached and detached from the apparatus. The display may be a single-screen or a multi-screen display. A single physical screen can include multiple displays that are managed as separate logical displays permitting different content to be displayed on separate displays although part of the same physical screen.

The apparatuses and units described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a hardware component may include multiple processors or a processor and a controller. In addition, different processing configurations are possible, such as parallel processors.

The methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The media may also include, alone or in combination with the software program instructions, data files, data structures, and the like. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

As a non-exhaustive illustration only, a terminal/device/unit described herein may refer to mobile devices such as, for example, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a personal digital assistant (PDA), a digital camera, a portable game console, an MP3 player, a portable/personal multimedia player (PMP), a handheld e-book, an ultra mobile personal computer (UMPC), a portable lab-top PC, a global positioning system (GPS) navigation, and devices such as a high definition television (HDTV), an optical disc player, a DVD player, a Blue-ray player, a setup box, or any other device capable of wireless communication or network communication consistent with that disclosed herein. In a non-exhaustive example, the wearable device may be self-mountable on the body of the user, such as, for example, the glasses or the bracelet. In another non-exhaustive example, the wearable device may be mounted on the body of the user through an attaching device, such as, for example, attaching a smart phone or a tablet to the arm of a user using an armband, or hanging the wearable device around the neck of a user using a lanyard.

A computing system or a computer may include a microprocessor that is electrically connected to a bus, a user interface, and a memory controller, and may further include a flash memory device. The flash memory device may store N-bit data via the memory controller. The N-bit data may be data that has been processed and/or is to be processed by the microprocessor, and N may be an integer equal to or greater than 1. If the computing system or computer is a mobile device, a battery may be provided to supply power to operate the computing system or computer. It will be apparent to one of ordinary skill in the art that the computing system or computer may further include an application chipset, a camera image processor, a mobile Dynamic Random Access Memory (DRAM), and any other device known to one of ordinary skill in the art to be included in a computing system or computer. The memory controller and the flash memory device may constitute a solid-state drive or disk (SSD) that uses a non-volatile memory to store data.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A column driver of a display device, comprising:

an upper output buffer configured to be driven between a first voltage rail and a second voltage rail, and output a first output signal in response to a first input signal and a second input signal;

a bottom output buffer configured to be driven between the second voltage rail and a third voltage rail, and output a second output signal in response to a third input signal and a fourth input signal;

a first switch group configured to selectively provide the first to the fourth input signals for a first or a second input terminal of each of the upper output buffer and the bottom output buffer;

a second switch group configured to feed back the first and the second output signals to the first or the second input terminal of each of the upper output buffer and the bottom output buffer; and a third switch group configured to selectively provide the first output signal and the second output signal to a first panel and a second panel, wherein upon both the first switch group and the second switch group being driven by either the first voltage rail or the second voltage rail, the third switch group is configured to be driven only by the first voltage rail.

2. The column driver of the display device of claim 1, wherein the upper output buffer is connected to a high power voltage from the first voltage rail and connected to a half power voltage from the second voltage rail, and wherein the bottom output buffer is connected to a half power voltage from the second voltage rail and connected to a low power voltage from the third voltage rail.

3. The column driver of the display device of claim 2, wherein the half power voltage is a half level voltage intermediate between the high power voltage of the first voltage rail and the low power voltage of the third voltage rail.

4. The column driver of the display device of claim 1, wherein the first switch group comprises:

an eleventh switch configured to provide the first input signal for a first input terminal of the upper output buffer;

a twelfth switch configured to provide the second input signal for a second input terminal of the upper output buffer;

a thirteenth switch configured to provide the third input signal for a first input terminal of the bottom output buffer; and a fourteenth switch configured to provide the fourth input signal for a second input terminal of the bottom output buffer.

5. The column driver of the display device of claim 4, wherein the second switch group comprises:

a twenty-first switch configured to feed back the first output signal to the first input terminal of the upper output buffer;

a twenty-second switch configured to feed back the first output signal to the second input terminal of the upper output buffer;

a twenty-third switch configured to feed back the second output signal to the first input terminal of the bottom output buffer; and a twenty-fourth switch configured to feed back the second output signal to the second input terminal of the bottom output buffer.

6. The column driver of the display device of claim 5, wherein in response to the eleventh to the fourteenth switches being provided with the high power voltage of the first voltage rail, the twenty-first to the twenty-fourth switches are provided with the high power voltage of the first voltage rail, or the twenty-first and the twenty-second switches are provided with the high power voltage of the first voltage rail and the twenty-third and the twenty-fourth switches are provided with the half power voltage of the second voltage rail, or the twenty-first to the twenty-fourth switches are provided with the half power voltage of the second voltage rail.

7. The column driver of the display device of claim 5, wherein in response to the eleventh and the twelfth switches being provided with the high power voltage of the first voltage rail and the thirteenth and the fourteenth switches being provided with the half power voltage of the second voltage rail, the twenty-first to the twenty-fourth switches are provided with the high power voltage of the first voltage rail, or the twenty-first and the twenty-second switches are provided with the high power voltage of the first voltage rail and the twenty-third and the twenty-fourth switches are provided with the half power voltage of the second voltage rail, or the twenty-first to the twenty-fourth switches are provided with the half power voltage of the second voltage rail.

8. The column driver of the display device of claim 5, wherein in response to the eleventh to the fourteenth switches being provided with the half power voltage of the second voltage rail, the twenty-first to the twenty-fourth switches are provided with the high power voltage of the first voltage rail, or the twenty-first and the twenty-second switches are provided with the high power voltage of the first voltage rail and the twenty-third and the twenty-fourth switches are provided with the half power voltage of the second voltage rail, or the twenty-first to the twenty-fourth switches are provided with the half power voltage of the second voltage rail.

9. The column driver of the display device of claim 1, wherein the third switch group comprises:

a thirty-first switch configured to provide the first output signal for the first panel;

a thirty-third switch configured to provide the first output signal for the second panel;

a thirty-second switch configured to provide the second output signal for the first panel; and a thirty-fourth switch configured to provide the second output signal for the second panel.

10. The column driver of the display device of claim 9, further comprising: a fortieth switch configured to make the signals provided to the first panel and the second panel separate.

11. The column driver of the display device of claim 1, further comprising:

a first regulator and a second regulator configured to:

generate the high power voltage, the half power voltage and the low power voltage, and provide the voltages for the first to the third voltage rails selectively.

12. The column driver of the display device of claim 11, wherein the first regulator and the second regulator are connected with an external printed circuit board (PCB) or integrated circuit (IC) and each other in a row.

13. The column driver of the display device of claim 1, further comprising:

a positive decoder configured to provide voltages to each of switches in the first switch group; and a negative decoder configured to provide voltages to each of the switches in the first switch group.

14. The column driver of the display device of claim 13, wherein the voltages provided by the positive and negative decoders are voltages from at the first voltage rail or the second voltage rail.

15. The column driver of the display device of claim 13, wherein the positive decoder is further configured to provide a voltage to each of the switches in the second switch group, and wherein the negative decoder is further configured to provide a voltage to each of the switches in the second switch group.

16. The column driver of the display device of claim 15, wherein the voltages provided by the positive and negative decoders are voltages from the first voltage rail or the second voltage rail.

* * * * *